US009929464B2

(12) United States Patent
Vortmeier et al.

(10) Patent No.: US 9,929,464 B2
(45) Date of Patent: Mar. 27, 2018

(54) ANTENNA ASSEMBLY AND ANTENNA STRUCTURE WITH IMPROVED SIGNAL-TO-NOISE RATIO

(75) Inventors: Gunther Vortmeier, Aichtal (DE); Christoph Degen, Krefeld (DE); Stefan Droste, Herzogenrath (DE)

(73) Assignee: Saint-Gobain Glass France, Courbevoie (FR)

( * ) Notice: Subject to any disclaimer, the term of this patent is extended or adjusted under 35 U.S.C. 154(b) by 857 days.

(21) Appl. No.: 13/581,754

(22) PCT Filed: Jun. 14, 2011

(86) PCT No.: PCT/EP2011/059807
§ 371 (c)(1),
(2), (4) Date: Feb. 13, 2013

(87) PCT Pub. No.: WO2011/157689
PCT Pub. Date: Dec. 22, 2011

(65) Prior Publication Data

US 2013/0141289 A1 Jun. 6, 2013

(30) Foreign Application Priority Data

Jun. 14, 2010 (EP) ..... 10165892

(51) Int. Cl.
*H01Q 1/32* (2006.01)
*H01Q 1/50* (2006.01)
(Continued)

(52) U.S. Cl.
CPC ..... *H01Q 1/50* (2013.01); *H01Q 1/1285* (2013.01); *H01Q 1/27* (2013.01); *H01Q 1/44* (2013.01); *H01Q 1/48* (2013.01)

(58) Field of Classification Search
CPC ..... H01Q 1/1285; H01Q 1/44; H01Q 1/27; H01Q 1/50; H01Q 1/48
(Continued)

(56) References Cited

U.S. PATENT DOCUMENTS 4,746,925 A * 5/1988 Toriyama ..... 343/713
5,285,048 A 2/1994 Nakase
(Continued)

FOREIGN PATENT DOCUMENTS

EP 0 961 12/1999
EP 1 686 648 8/2006
(Continued)

OTHER PUBLICATIONS

International Preliminary Report on Patentability and Written Opinion dated Dec. 14, 2012 in PCT/EP2011/059807 filed Jun. 14, 2011 with English language translation.
(Continued)

*Primary Examiner* — Peguy Jean Pierre
(74) *Attorney, Agent, or Firm* — Oblon, McClelland, Maier & Neustadt, L.L.P.

(57) ABSTRACT

An antenna assembly including: an insulating substrate; a conductive coating covering a surface of the substrate at least section-wise and serving at least section-wise as a planar antenna receiving electromagnetic waves; a first coupling electrode electrically coupled to the conductive coating extracting useful signals from the planar antenna; a source of interference disposed such that interfering signals can be received by the planar antenna; an electrically conductive ground; and a second coupling electrode electrically coupled to the conductive coating coupling out interfering signals received by the planar antenna from the planar antenna. The second coupling electrode includes a first coupling surface and the conductive structure includes a
(Continued)

second coupling surface capacitively coupled to the first coupling surface, the two coupling surfaces configured to selectively allow passage of a frequency range corresponding to the interfering signals to be extracted from the planar antenna.

9 Claims, 16 Drawing Sheets

(51) Int. Cl.

| | |
|---|---|
| ***H01Q 1/12*** | (2006.01) |
| ***H01Q 1/44*** | (2006.01) |
| ***H01Q 1/48*** | (2006.01) |
| ***H01Q 1/27*** | (2006.01) |

(58) Field of Classification Search
USPC ..... 343/711, 713
See application file for complete search history.

(56) References Cited

U.S. PATENT DOCUMENTS

| | | | | |
|---|---|---|---|---|
| 6,292,150 | B1 * | 9/2001 | Doi et al. | 343/713 |
| 7,388,548 | B2 | 6/2008 | Maeuser | |
| 2006/0273966 | A1 | 12/2006 | Maeuser | |

FOREIGN PATENT DOCUMENTS

| | | |
|---|---|---|
| FR | 2 608 844 | 12/1987 |
| WO | WO 93/23890 | 11/1993 |
| WO | 2004 100311 | 11/2004 |

OTHER PUBLICATIONS

U.S. Appl. No. 13/581,588, filed Aug. 28, 2012, Vortmeier, et al.
International Search Report dated Jan. 20, 2012 in PCT/EP11/59807 Filed Jun. 14, 2011.

* cited by examiner

B-B

A-A

B-B

A-A

B-B

A-A

B-B

B-B

A-A

A-A

ANTENNA ASSEMBLY AND ANTENNA STRUCTURE WITH IMPROVED SIGNAL-TO-NOISE RATIO

The invention relates to an antenna assembly and an antenna structure with a planar antenna for receiving electromagnetic waves, as well as a method for operating an antenna assembly.

Substrates with electrically conductive coatings have already been described frequently in the patent literature. Merely by way of example, reference is made in this regard to the publications DE 19858227 C1, DE 10200705286, DE 102008018147 A1, and DE 102008029986 A1. As a general rule, the conductive coating serves for reflection of heat rays and thus provides for an improvement of thermal comfort, for example, in motor vehicles or in buildings. Frequently, it is also used as a heating layer to heat the entire surface of a transparent pane.

As is known, for example, from the publications DE 10106125 A1, DE 10319606 A1, EP 0720249 A2, US 2003/0112190 A1, and DE 19843338 C2, because of their electrical conductivity, transparent coatings can also be used as planar antennas for reception of electromagnetic waves. For this purpose, the conductive coating is galvanically or capacitively coupled to a coupling electrode and the antenna signal is made available in the edge region of the pane. Customarily, the antenna signal is fed to an antenna amplifier which is specially connected in motor vehicles to the electrically conductive vehicle body, with a reference potential effective for high-frequency applications predetermined for the antenna signal by this electrical connection. The difference between the reference potential and the potential of the antenna signal yields the available antenna power.

Now, because of the large antenna surface, electromagnetic signals can be received with the planar antenna within a relatively large area. The result, for example, in motor vehicles, is that, in addition to the useful signals, undesirable interfering signals from electrical devices, such as cameras, sensors, the instrument panel, engine control devices, and the like, can be received by the planar antenna. The signal-to-noise ratio (SNR) of the planar antenna can worsen significantly due to these interfering signals.

A common approach for improving the signal-to-noise ratio consists in preventing interfering signals by suppressing and shielding the sources of interference. In addition, the influence of interfering signals can be reduced if a relatively large geometric distance is maintained between sources of interference and the planar antenna. However, in practice, the realization of these requirements is for the most part associated with difficulties. On the one hand, suppression and shielding of sources of interference is technically complex and associated with relatively high costs. On the other, an appropriately large distance between sources of interference and the planar antenna can often not be maintained, for example, in the case of a front-mounted engine and a planar antenna applied on the windshield. The situation is further complicated by the fact that in modern motor vehicles electrical devices are often provided in the vicinity of the foot point of the inside rear view mirror, which devices can act as sources of interference for a planar antenna on the windshield. A practical remedy can optionally be obtained only by applying the planar antenna to the rear window.

In contrast, the object of the present invention consists in further improving conventional antenna assemblies with a planar antenna such that, despite the presence of sources of interference that emit interfering signals to the planar antenna, useful signals can be received with a satisfactory signal-to-noise ratio. Furthermore, such an antenna assembly should be simply and cost-effectively producible in series production and should function reliably and safely. These and other objects are accomplished by means of an antenna assembly (system), an antenna structure, and a method for operating an antenna assembly with the characteristics of the independent claims. Advantageous embodiments of the invention are set forth through the characteristics of the dependent claims.

The antenna assembly of the present invention comprises at least one electrically insulating, preferably transparent substrate, as well as at least one electrically conductive, preferably transparent coating, which covers at least one surface of the substrate at least section-wise (at least a section thereof) and serves at least section-wise (at least in a section thereof) as a plane-shaped antenna (planar antenna) for receiving electromagnetic waves. The conductive coating is suitably configured for use as a planar antenna and can, for this purpose, largely cover the substrate. The antenna assembly can, for example, include a single pane glass or a laminated pane. As a rule, the laminated pane comprises two preferably transparent first substrates, which correspond to an inner and outer pane that are fixedly bonded to each other by at least one thermoplastic adhesive layer, with the conductive coating possibly situated on at least one surface of at least one of the two first substrates of the laminated pane. Moreover, the laminated pane can be provided with another second substrate different from the first substrate that is situated between the two first substrates. The second substrate can serve additionally or alternatively to the first substrate as a carrier for the conductive coating, with at least one surface of the second substrate provided with the conductive coating.

The antenna assembly according to the invention further includes at least one first coupling electrode electrically coupled to the conductive coating for extracting (coupling out) useful signals from the planar antenna. The first coupling electrode can, for example, be coupled capacitively or galvanically to the conductive coating.

The antenna assembly further includes at least one source of interference, which is disposed such that interfering signals are electromagnetically receivable by the planar antenna, as well as an electrically conductive structure acting as a ground, for example, a metallic motor vehicle body or a metallic window frame of a motor vehicle. The antenna assembly according to the invention further includes at least one second coupling electrode electrically coupled to the conductive coating for the capacitive extraction (coupling out) of interfering signals of the at least one external source of interference received by the planar antenna from the planar antenna. The second coupling electrode can be capacitively or galvanically coupled to the conductive coating. Accordingly, the antenna assembly according to the invention serves, in particular, for extracting (coupling out) interfering signals from the planar antenna, which signals were received by the planar antenna as electromagnetic waves, in other words, the interfering signals are not transferred via a galvanic or capacitive coupling through a separate electrical component (capacitor) into the planar antenna, but are received by the planar antenna in its function as an antenna.

According to the invention, the at least one second coupling electrode is capacitively coupled to the conductive structure acting as an electrical ground, with the second coupling electrode having a first coupling surface and the conductive structure having a second coupling surface (coupling counter surface) capacitively coupled to the first coupling surface. The capacitive coupling surface of the at least one second coupling electrode and of the electrically conductive structure acting as an electrical ground are suitably configured for capacitive coupling, in other words, they are disposed opposite each other with a suitable distance between them.

The capacitively coupled coupling surfaces are configured such that they selectively allow passage of a predefinable frequency range, which preferably corresponds to the frequency range of the interfering signals to be extracted (coupled out) from the planar antenna, in other words, the capacitive coupling surfaces do not allow passage of frequencies differing therefrom. In particular, the capacitive coupling surfaces selectively allow passage of a frequency range above a threshold frequency or passthrough frequency of 170 MHz, corresponding to the frequency range of the terrestrial broadcast bands III-V, which can be received well by a linear antenna. The desired frequency selectivity can be adjusted in a simple manner through the size and distance between the capacitively coupled coupling surfaces, in other words, the size and distance between the capacitive coupling surfaces are implemented so as to allow passage of the frequency range of the interfering signals of the source(s) of interference.

In a particularly advantageous embodiment of the antenna assembly according to the invention, the at least one second coupling electrode is implemented in the form of a protruding (flat) edge section of the conductive coating, with the protruding edge section implemented to be capacitively coupled opposite the second coupling surface of the conductive structure acting as a ground. This measure enables particularly simple and cost-effective realization of the antenna assembly according to the invention in series production, since the at least one second coupling electrode can be produced as a section of the conductive coating. However, it would also be conceivable to produce the second coupling electrode, for example, from a metal foil strip that is galvanically or capacitively coupled to the conductive coating.

In the antenna assembly according to the invention, it is advantageous for the at least one second coupling electrode for extracting (coupling out) the interfering signals from the planar antenna to be disposed near the first coupling electrode for extracting the useful signals from the planar antenna. Generally speaking, antenna signals are extracted on the different coupling electrodes depending on the difference in potential and the distance from a surface section of the conductive coating serving as a planar antenna: the greater the difference in potential between a surface section of the conductive coating and the coupling electrode and the smaller the distance to this section, the more signal the coupling electrode extracts (and the less signal is then extracted on another "competing" coupling electrode). In the antenna assembly according to the invention, by means of the spatially near arrangement of the first coupling electrode and the at least one second coupling electrode, it can advantageously be achieved that differences in potential occurring at the time of signal reception are substantially the same for both coupling electrodes. Through the frequency-selective passthrough behavior of the at least one second coupling electrode, it can further be achieved that interfering signals are extracted (coupled out) via the second coupling electrode and useful signals are extracted (coupled out) via the first coupling electrode. By means of the spatially near arrangement of the first coupling electrode and the at least one second coupling electrode, it can also be achieved that interfering signals of all sources of interference acting on the planar antenna above the threshold frequency or passthrough frequency of the second coupling electrode are reliably and safely extracted from the planar antenna. The signal-to-noise ratio of the planar antenna can thus be significantly improved. The term "near" is understood to mean an arrangement of the first coupling electrode and the at least one second coupling electrode when the coupling electrodes bring about the aforementioned desired effect. In particular, the at least one second coupling electrode can, for this purpose, have a distance from the first coupling electrode that is less than one fourth of the minimum wavelength of the interfering signals extracted from the planar antenna. By means of this measure, the signal-to-noise ratio of the planar antenna can be improved particularly well.

In another advantageous embodiment of the antenna assembly according to the invention, the second coupling electrode is disposed between a area zone of the conductive coating (referred to in the following as "source of interference area zone"), whose points are distinguished in that they have an extremely short distance from the source of interference generally implemented physically, and the first coupling electrode. The points of the source of interference area zone can have, in particular, an extremely short vertical distance from the source of interference. The source of interference area zone can, for example, be a projection zone that results from projection, in particular, or orthogonal parallel projection of the source of interference onto the conductive coating. The generally physical source of interference can be perceived in the projection as a flat extensive body. By means of the second coupling electrode disposed between the source of interference area zone and the first coupling electrode, a spatially selective extraction (coupling out) of interfering signals from the planar antenna can advantageously occur without substantially impairing the reception of useful signals. Due to the distance condition between the source of interference and the source of interference area zone, interfering signals of the source of interference are received in the source of interference area zone with extremely high signal amplitude or signal intensity. Differences in potential between a surface section of the conductive coating and the second coupling electrode occurring at the time of reception of the interfering signals are greater than differences in potential between this surface section and the first coupling electrode such that the interfering signals can largely be extracted by the second coupling electrode. The shape of the source of interference area zone depends generally on the shape of the source of interference. In addition, by means of the spatial position of the second coupling electrode between the source of interference area zone and the first coupling electrode, a preferred extraction of interfering signals via the second coupling electrode can be achieved. The first coupling electrode can further retain useful signals from flat sections of the planar antenna, which are largely extracted by the first coupling electrode. The signal-to-noise ratio of the planar antenna can thus be significantly improved. It can be advantageous for the at least one second coupling electrode to have a distance from the source of interference area zone that is less than one fourth of the minimum wavelength of the interfering signals, as a result of which a further improvement of the signal-to-noise ratio of the planar antenna can be achieved.

In another advantageous embodiment of the antenna assembly according to the invention, the at least one second coupling electrode is disposed near a source of interference area zone of the conductive coating, whose points have a distance as short as possible from the at least one source of interference and thus an extremely high signal amplitude relative to the interfering signals of the source of interference. By means of the second coupling electrode, a spatially selective extraction of interfering signals from the planar antenna can advantageously occur without substantially impairing the reception of useful signals. The near arrangement of the second coupling electrode to the source of interference area zone causes, at the time of reception of the interfering signals of the source of interference, differences in potential between a surface section of the planar antenna containing the source of interference area zone and the second coupling electrode, which are greater than the differences in potential between this surface section and the first coupling electrode, such that the interfering signals are largely extracted by the second coupling electrode. The first coupling electrode can further retain useful signals from flat sections of the planar antenna in which differences in potential occur that are greater than differences in potential between a surface section containing the source of interference area zone and the first coupling electrode. The signal-to-noise ratio of the planar antenna can thus be significantly improved. It can be advantageous for the at least one second coupling electrode to have a distance from the source of interference area zone that is less than one fourth of the minimum wavelength of the interfering signals, by which means the signal-to-noise ratio of the planar antenna can be further improved.

In another advantageous embodiment of the antenna assembly, the first coupling electrode is electrically coupled to an unshielded, linear conductor, referred to in the following as "antenna conductor". The antenna conductor serves as a linear antenna for receiving electromagnetic waves. In this case, the linear conductor is situated outside an area that can be projected by orthogonal parallel projection onto the planar antenna serving as a projection area, by means of which an antenna foot point of the linear antenna becomes a common antenna foot point of the linear and planar antenna. The first coupling electrode can, for example, be capacitively or galvanically coupled to the linear antenna conductor. In this embodiment, the antenna assembly thus has a hybrid structure made of a planar and linear antenna.

The antenna conductor serves as a linear antenna and is suitably configured for this purpose, in other words, it has a form suitable for receiving in the desired frequency range. In contrast and in differentiation from planar emitters, linear antennas or linear emitters have a geometric length (L) that exceeds their geometric width (B) by multiple orders of magnitude. The geometric length of a linear emitter is the distance between the antenna foot point and the antenna tip; the geometric width is the dimension perpendicular thereto. As a rule, for linear emitters, the following relationship applies: $L/B \geq 100$. For their geometric height (H), as a rule, a corresponding relationship $L/H \geq 100$ applies, where "geometric height (H)" means a dimension that is both perpendicular to the length (L) and also perpendicular to the width (B). A satisfactory antenna signal can be provided by linear emitters in the range of the terrestrial broadcast bands II through V. According to a definition of the International Telecommunication Union (ITU), this is the frequency range from 87.5 MHz to 862 MHz (band II: 87.5-108 MHz, band III: 174-230 MHz, band IV: 470-606 MHz, band V: 606-862 MHz). However, satisfactory reception performance cannot be obtained in the preceding frequency range of band I (47-68 MHz). The same is also true for frequencies below band I.

It is essential in the hybrid antenna assembly that the antenna conductor be situated outside an area defined by a projection operation, which is defined in that each point of the area can be projected by orthogonal parallel projection onto the conductive coating or planar antenna serving as the projection area. If the conductive coating is active as a planar antenna only section-wise, only the part of the conductive coating active as a planar antenna serves as the projection area. The antenna conductor is thus not situated in the area defined by the projection operation. As is customary, in parallel projection, the projection beams are parallel to each other and strike the projection area at a right angle, which projection area is, in the present case, the conductive coating serving as a planar antenna or the part thereof active as a planar antenna, with the projection center at infinity. With a flat substrate and an accordingly flat conductive coating, the projection area is a projection plane containing the coating. Said area is delimited by an (imagined) edge surface that is positioned on the circumferential edge of the conductive coating or on the circumferential edge of the part of the conductive coating active as a planar antenna and is perpendicular to the projection area.

In the hybrid antenna assembly, an antenna foot point of the linear antenna becomes a common antenna foot point of the linear and planar antenna. As is customary, the term "antenna foot point" describes an electrical contact for picking up received antenna signals, on which, in particular, a reference to a reference potential (e.g., ground) exists for determining the signal level of the antenna signals. The hybrid antenna assembly thus advantageously enables good reception with a high bandwidth which combines the favorable reception characteristics of the planar emitter in the frequency ranges of bands I and II with the favorable reception characteristics of the linear emitter in the frequency ranges of the bands II through V. By means of positioning of the linear emitter outside the area projectable onto the planar antenna by orthogonal parallel projection, electrical load of the linear emitter by the planar emitter can be particularly advantageously avoided. The hybrid antenna assembly thus makes the entire frequency range of the bands I through V available with a satisfactory reception performance, for example, for a windshield serving as an antenna pane.

In the hybrid antenna assembly, the antenna conductor can be specially adapted for reception in the range of the terrestrial broadcast bands III-V, and can have, for this purpose, preferably, a length of more than 100 millimeters (mm) and a width of less than 1 mm as well as a height of less than 1 mm, corresponding to a relationship length/width$\geq$100 or $L/H \geq 100$. For the desired purpose, it is further preferred for the antenna conductor to have a distributed resistance of less than 20 ohms/m, particularly preferably less than 10 ohms/m. Moreover, in the hybrid antenna assembly, the first coupling electrode can be electrically coupled to the conductive coating such that the reception performance (signal level) of the planar antenna is as high as possible. This measure advantageously enables optimization of the signal level of the planar antenna for improvement of the reception characteristics of the hybrid antenna assembly. Moreover, in the hybrid antenna assembly, the common antenna foot point of the planar and linear antenna can be electrically conductively connected via a connector conductor to an electronic signal processing device for processing of received antenna signals, for example, an antenna amplifier, with the connector contact disposed such that the length of the connector conductor is as short as possible. This measure advantageously makes it possible that it is not absolutely necessary to use a specific high-frequency conductor for the connector conductor with a signal conductor and at least one accompanying ground conductor, but rather that because of the short signal transmission path, a more economical signal conductor not provided specifically for high-frequency transmission, such as an unshielded stranded wire or a strip-shaped flat conductor, that can, moreover, be connected using a relatively low complexity connection technique. This makes significant cost savings in the production of the hybrid antenna assembly possible. In addition, in the hybrid antenna assembly, the conductive coating can cover the surface of the substrate except for a circumferential, electrically insulating edge strip, with the antenna conductor situated inside an area that can be projected by orthogonal parallel projection on to the edge strip serving as a projection area. For this purpose, the antenna conductor can, for example, be applied on the substrate in the region of the edge strip. This measure enables particularly simple production of the hybrid antenna assembly. For the case in which the hybrid antenna assembly is realized in the form of a laminated pane, the conductive coating can be situated on one surface of the at least one substrate and the linear antenna conductor on a different surface therefrom of the same or a different substrate therefrom. By means of this measure, particularly simple production of the hybrid antenna assembly according to the invention can be realized. In addition, in the hybrid antenna assembly the first coupling electrode and the antenna conductor can be electrically conductively connected to each other, providing, in particular, the possibility of designing the first coupling electrode independent of the electrical connection to the linear antenna conductor, by which means the performance of the hybrid antenna assembly can be improved. Also, in the hybrid antenna assembly, the antenna conductor can be situated on one surface of the at least one substrate and the common antenna foot point can be situated on a different surface therefrom of the same or of a different substrate therefrom. For this purpose, the antenna conductor and the common antenna foot point are electrically conductively connected to each other via a second connection conductor. By means of this measure, the electrical connection of the common antenna foot point to the downstream antenna electronics, in particular, can be realized particularly simply. In addition, in the hybrid antenna assembly, the linear antenna conductor made of a metallic printing paste can be printed, for example, using the screenprinting method, onto the at least one substrate or can be laid in the form of a wire, by which means particularly simple production of the antenna conductor is enabled. Also, in the hybrid antenna assembly, at least one of the conductors, selected from among the first coupling electrode, the first connection conductor, and the second connection conductor, can lead to the edge of the at least one substrate and can be implemented as a flat conductor with a tapering width in the region of the edge. By means of this measure, a reduced coupling surface can be advantageously obtained on the substrate edge, for example, for reduction of a capacitive coupling with the electrically conductive motor vehicle body when the conductor comes out of the laminated pane. Also, in the hybrid antenna assembly, the linear antenna and the first coupling electrode as well as the two connection conductors (if present) can be masked by an opaque masking layer, by means of which the visual appearance of the antenna assembly can be improved. Also, in the hybrid antenna assembly, the conductive coating can comprise at least two planar segments that are electrically isolated from each other by at least one linear, electrically insulating region. In addition, at least one planar segment is divided by linear electrically insulating regions. It is particularly advantageous if a, in particular, circumferential edge region of the conductive coating has a plurality of planar segments that are divided by linear electrically insulating regions. Reference is made with regard to such a segmentation of the conductive coating to the unpublished international patent application PCT/EP2009/066237, the content of which is hereby incorporated in this application by reference.

In a particularly advantageous manner, in the hybrid antenna assembly, interfering signals that lie in a frequency range that can be received well by the linear antenna, namely the frequency range of the terrestrial broadcast bands III-V above 170 MHz, can be extracted from the planar antenna. Thus, no losses at all occur in the useful signal portion of the planar antenna. Accordingly, the second coupling electrode preferably has a high pass range corresponding to the frequency range of the terrestrial broadcast bands III-V, in particular corresponding to the frequency range of the terrestrial broadcast bands IV and V.

The invention further extends to an antenna structure with at least one electrically insulating, in particular transparent substrate; at least one electrically conductive, in particular transparent coating, which covers a surface of the substrate at least section-wise (at least a section thereof) and serves at least section-wise (at least in a section thereof) as a planar antenna for receiving electromagnetic waves; at least one first coupling electrode coupled to the conductive coating for extracting (coupling out) useful signals from the planar antenna; and at least one second coupling electrode electrically coupled to the conductive coating for extracting (coupling out) interfering signals of at least one source of interference from the planar antenna, wherein the at least one second coupling electrode has a first coupling surface that is configured for the purpose of being capacitively coupled to a second coupling surface of an electrically conductive structure acting as an electrical ground, wherein the first coupling surface is configured such that it, together with the second coupling surface, selectively allows passage of a frequency range that corresponds to the interfering signals to be extracted (coupled out) from the planar antenna.

In a preferred embodiment of the antenna structure according to the invention, the at least one second coupling electrode is configured in the form of a protruding edge section of the conductive coating.

The invention further extends to the use of an antenna structure as described above as a functional and/or decorative individual piece and as a built-in part in furniture, devices, and buildings, as well as in means of transportation for travel on land, in the air, or on water, in particular in motor vehicles, for example, as a windshield, a rear window, a side window, and/or a glass roof.

The invention further extends to a method for operating such an antenna assembly, wherein useful signals are extracted (coupled out) from the planar antenna via the first coupling electrode and interfering signals are selectively extracted (coupled out) from the planar antenna via the second coupling electrode.

The method comprises the following steps:

- reception of useful signals by means of a planar antenna, which is implemented in the form of an electrically conductive, in particular transparent coating applied on at least one electrically insulating, in particular transparent substrate;
- extraction (coupling out) of the useful signals from the planar antenna by means of a first coupling electrode electrically coupled to the coating;

selective extraction (coupling out) from the planar antenna of interfering signals of at least one source of interference (electromagnetically) received by the planar antenna by means of a second coupling electrode electrically coupled to the coating, which second coupling electrode is capacitively coupled to a conductive structure acting as a ground, for example, a metallic motor vehicle body or a metallic window frame, wherein the second coupling electrode has a first coupling surface and the conductive structure has a second coupling surface (coupling counter surface) capacitively coupled to the first coupling surface.

In an advantageous embodiment of the method according to the invention, the interfering signals received by the planar antenna are extracted (coupled out) from the planar antenna via at least one second coupling electrode configured in the form of a protruding edge section of the conductive coating.

The method according to the invention can, in particular, be realized in the above-described antenna assembly according to the invention.

It is understood that the various embodiments of the antenna assembly or of the antenna structure as well as of the method for operation of an antenna assembly according to the invention can be realized individually or in any combinations in order to achieve further improvements of the signal-to-noise ratio of the antenna assembly. In particular, the above mentioned characteristics and those to be illustrated in the following can be used not only in the combinations indicated, but also in other combinations or alone without departing from the scope of the present invention.

BRIEF DESCRIPTION OF THE DRAWINGS

The invention is now explained in detail based on exemplary embodiments, with reference to the accompanying figures. They depict in simplified representation that is not to scale.

DETAILED DESCRIPTION OF THE DRAWINGS

Figure 1:
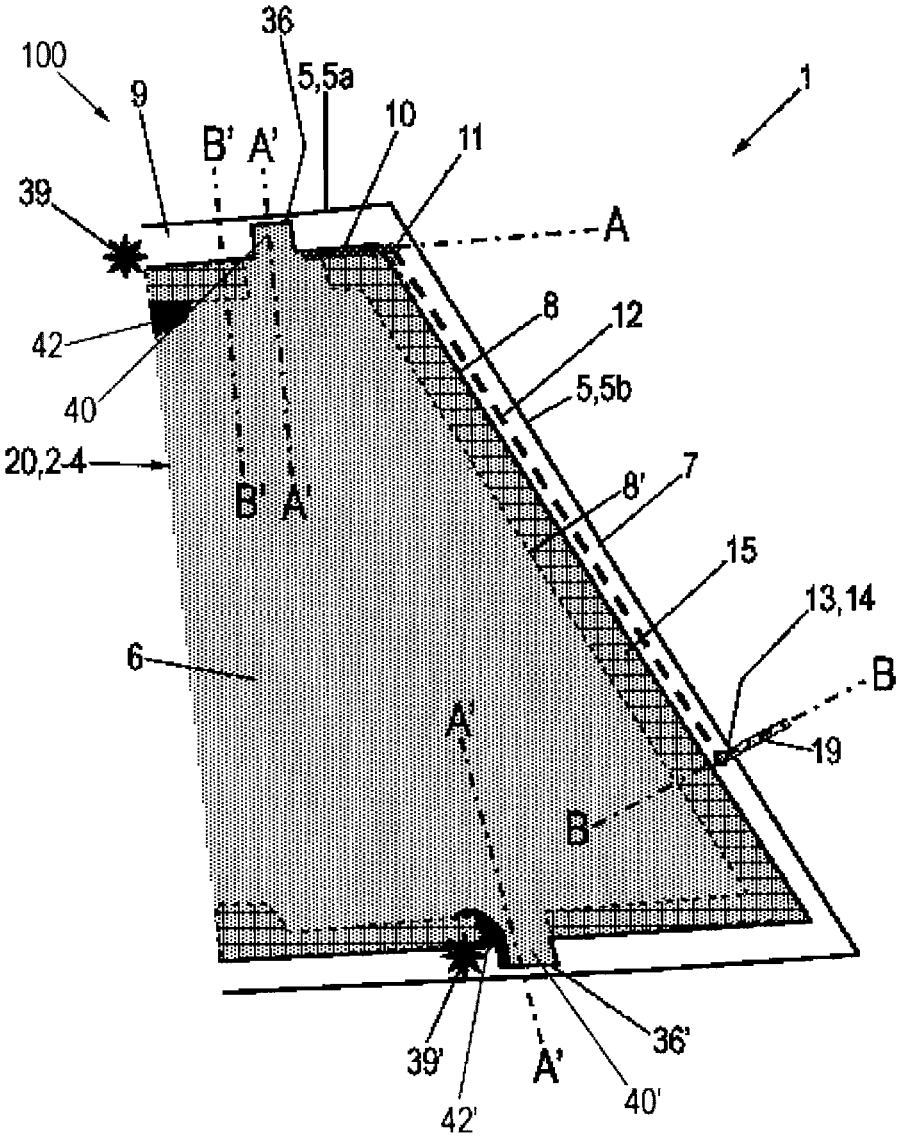
FIG. 1 a schematic perspective view of a hybrid antenna assembly according to a first exemplary embodiment of the invention embodied in the form of a laminated pane.

Considered first are FIG. 1 and FIGS. 2A through 2D, wherein a hybrid antenna structure, referred to as a whole by the reference character 1, as well as an antenna assembly 100 containing the antenna structure 1, is illustrated as a first exemplary embodiment of the invention. In this case, the hybrid antenna structure 1 is embodied, for example, as a transparent laminated pane 20, which is only partially depicted in FIG. 1. The laminated pane 20 is transparent to visible light, for example, in the wavelength range from 350 nm to 800 nm, with the term "transparency" meaning light permeability of more than 50%, preferably more than 75%, and particularly preferably more than 80%. The laminated pane 20 serves, for example, as a windshield of a motor vehicle, but it can also be used otherwise.

The laminated pane 20 comprises two transparent individual panes, namely a rigid outer pane 2 and a rigid inner pane 3, that are fixedly bonded to each other by a transparent thermoplastic adhesive layer 21. The individual panes have roughly the same size and are made, for example, from glass, in particular, float glass, cast glass, and ceramic glass, being equally possibly made from a non-glass material, for example, plastic, in particular polystyrene (PS), polyamide (PA), polyester (PE), polyvinyl chloride (PVC), polycarbonate (PC), polymethyl methacrylate (PMA), or polyethylene terephthalate (PET). Generally speaking, any material with sufficient transparency, adequate chemical resistance, as well as suitable shape and size stability can be used. For use elsewhere, for example, as a decorative piece, it would also be possible to make the outer and inner panes 2, 3 from a flexible material. The respective thickness of the outer and inner panes 2, 3 can vary widely depending on the application and, for glass, can, for example, be in the range from 1 to 24 mm.

The laminated pane 20 has an at least approximately trapezoidal curved contour (in FIG. 1 only partially discernible), which results from a common edge of the pane 5 made of the two individual panes 2, 3, with the edge of the pane 5 composed of two opposing long edges of the pane 5*a* and two opposing short edges of the pane 5*b*. In the conventional manner, the surfaces of the panes are referenced with Roman numerals I-IV, with "side I" corresponding to a first pane surface 24 of the outer pane 2; "side II", a second pane surface 25 of the outer pane 2; "side III", a third pane surface 26 of the inner pane 3; and "side IV", a fourth pane surface 27 of the inner pane 3. In the application as a windshield, side I is turned toward the outside environment and side IV is turned toward the passenger compartment of the motor vehicle.

The adhesive layer 21 for bonding the outer and inner pane 2, 3 is preferably made of an adhesive plastic, preferably based on polyvinyl butyral (PVB), ethylene vinyl acetate (EVA), and polyurethane (PU). In this case, the adhesive layer 21 is implemented, for example, as a bilayer in the form of two PVB films bonded together (not shown in detail in the figures).

Situated between the outer and inner pane 2, 3 is a an extensive carrier 4, preferably made from plastic, preferably based on polyamide (PA), polyurethane (PU), polyvinyl chloride (PVC), polycarbonate (PC), polyester (PE), and polyvinyl butyral (PVB), particularly preferably based on polyester (PE) and polyethylene terephthalate (PET). In this case, the carrier 4 is implemented, for example, in the form of a PET film. The carrier 4 is embedded between the two PVB films of the adhesive layer 21 and disposed parallel to the outer and inner pane 2, 3, roughly centered between the two, with a first carrier surface 22 facing the second pane surface 25 and a second carrier surface 23 facing the third pane surface 26. The carrier 4 does not extend all the way to the edge of the pane 5, such that a carrier edge 29 is set back inward relative to the edge of the pane 5 and a carrier-free circumferential edge zone 28 of the laminated 20 remains on all sides. The edge zone 28 serves in particular as electrical insulation of the conductive coating 6 toward the outside, for example, for reduction of a capacitive coupling with the electrically conductive motor vehicle body, made, as a rule, from sheet metal. Moreover, the conductive coating 6 is protected against moisture penetrating from the edge of the pane 5.

Applied on the second carrier surface 23 is a transparent, electrically conductive coating 6, which is delimited on all sides by a circumferential coating edge 8. The conductive coating 6 covers an area, which is more than 50%, preferably more than 70%, particularly preferably more than 80%, and even more preferably more than 90% of the surface of the second pane surface 25 or of the third pane surface 26. The area covered by the conductive coating 6 preferably amounts to more than 1 $m^2$ and can, generally speaking, despite the use of the laminated pane 20 as a windshield, be, for example, in the range from 100 $cm^2$ to 25 $m^2$. The transparent, electrically conductive coating 6 contains or is made of at least one electrically conductive material. Examples for this are metals with high electrical conductivity such as silver, copper, gold, aluminum, or molybdenum, metal alloys, such as silver alloyed with palladium, as well as transparent, electrically conductive oxides (TCOs=transparent conductive oxides). Preferred TCOs are indium tin oxide, fluoride-doped tin dioxide, aluminum-doped tin dioxide, gallium-doped tin dioxide, boron-doped tin dioxide, tin zinc oxide, or antimony-doped tin oxide.

The conductive coating 6 can consist of one individual layer with such a conductive material or of a layer sequence that contains at least one such individual layer. For example, the layer sequence can comprise at least one layer made of a conductive material and at least one layer made of a dielectric material. The thickness of the conductive coating 6 can vary widely depending on the application, with the thickness at any location in the range from 30 nm to 100 μm. In the case of TCOs, the thickness is preferably in the range from 100 nm to 1.5 μm, more preferably in the range from 150 nm to 1 μm, particularly preferably in the range from 200 nm to 500 nm. When the conductive coating consists of a layer sequence with at least one layer made of an electrically conductive material and at least one layer made of a dielectric material, the thickness is preferably 20 nm to 100 μm, more preferably 25 nm to 90 μm, and particularly preferably 30 nm to 80 μm. The layer sequence advantageously has high thermal stability such that it withstands, without damage, the temperatures of typically more than 600° C. necessary for the bending of glass panes; however, layer sequences with low thermal stability can also be provided. The sheet resistance of the conductive coating 6 is preferably less than 20 ohms and is, for example, in the range from 0.5 to 20 ohms. In the exemplary embodiment depicted, the sheet resistance of the conductive coating 6 is, for example, 4 ohms.

The conductive coating 6 is preferably deposited from the gas phase, for which purpose methods known per se, such as chemical vapor deposition (CVD) or physical vapor deposition (PVD), can be used. Preferably, the coating 6 is applied by sputtering (magnetron cathode sputtering).

In the laminated pane 20, the conductive coating 6 serves as a planar antenna for reception of electromagnetic waves, preferably in the frequency range of the terrestrial broadcast bands I and II. For this purpose, the conductive coating 6 is electrically coupled to a first coupling electrode 10, which is implemented in this case, for example, as a strip-shaped flat conductor. In the exemplary embodiment, the first coupling electrode 10 is galvanically coupled to the conductive coating 6, with the provision of a capacitive coupling equally possible. The strip-shaped first coupling electrode 10 is made, for example, from a metallic material, preferably silver, and is, for example, printed on by screenprinting. It has, preferably, a length of more than 10 mm with a width of 5 mm or more, more preferably a length of more than 25 mm with a width of 5 mm or more. In the exemplary embodiment, the first coupling electrode 10 has a length of 300 mm and a width of 5 mm. The thickness of the first coupling electrode 10 is preferably less than 0.015 mm. The specific conductivity of a first coupling electrode 10 made of silver is, for example, $61.35 \cdot 10^6$/ohm·m.

As depicted in FIG. 1, the first coupling electrode 10 runs on and in direct electrical contact with the conductive coating 6 roughly parallel to the upper coating edge 8 and extends into the carrier-free edge zone 28. In this case, the first coupling electrode 10 is disposed such that the antenna signals of the planar antenna are optimized with regard to its reception performance (signal level).

Figure 2A:
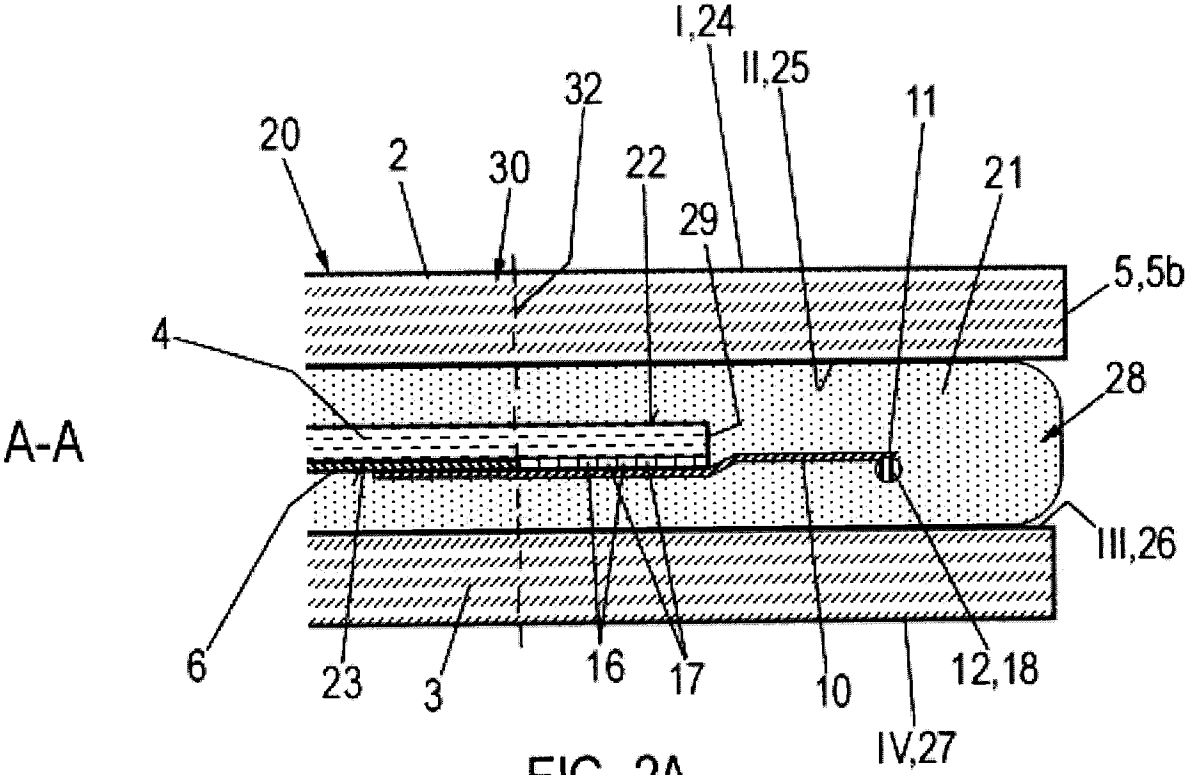
FIG. 2A-2D cross-sectional views of the hybrid antenna assembly of FIG. 1 along section line A-A (FIG. 2A), section line B-B (FIG. 2B), section line A'-A' (FIG. 2C), and section line B'-B' (FIG. 2D)
Figure 2B:
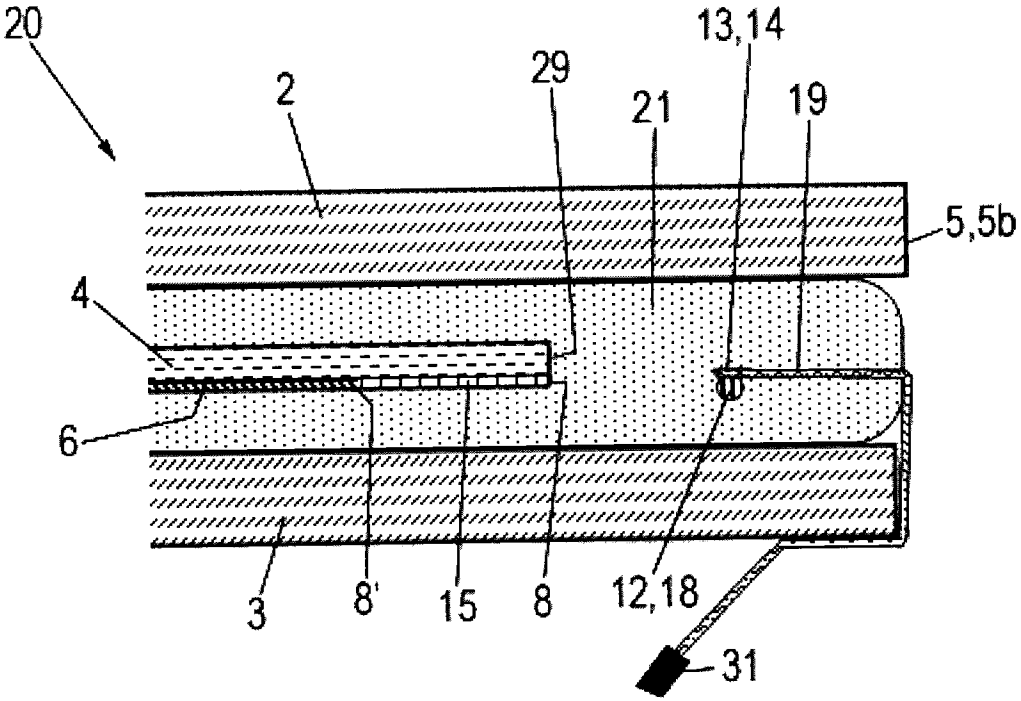

As depicted in FIGS. 2A and 2B, the conductive coating 6 is divided, in a strip-shaped edge region 15 adjacent the carrier edge 29, for example, by lasering, into a plurality of electrically insulated segments 16, between which, in each case, electrically insulating (stripped) regions 17 are situated. The edge region 15 runs substantially parallel to the carrier edge 29 and can, in particular, be circumferential on all sides. By means of this measure, a capacitive coupling of the conductive coating 6 to surrounding conductive structures, for example, an electrically conductive motor vehicle body, is prevented. Since the edge region 15 of the conductive coating 6 is not active as a planar antenna, a part of the conductive coating 6 active for the function as a planar antenna is delimited by a coating edge 8'.

Within the carrier-free edge zone 28 of the laminated pane 20, embedded in the adhesive layer 4, a linear, unshielded antenna conductor 12 is situated, which serves as a linear antenna for reception of electromagnetic waves, preferably in the frequency range of the terrestrial broadcast bands II through V, particularly preferably in the frequency range of the broadcast bands III through V and is suitably configured for this purpose. In the present exemplary embodiment, the antenna conductor 12 is implemented in the form of a wire 18, which is preferably longer than 100 mm and narrower than 1 mm. The distributed resistance of the antenna conductor 12 is preferably less than 20 ohm/m, particularly preferably less than 10 ohm/m. In the embodiment depicted, the length of the antenna conductor 12 is ca. 650 mm with a width of 0.75 mm. Its distributed resistance is, for example, 5 ohm/m.

The antenna conductor 12 has, in this case, for example, an at least approx. straight-line course and is located completely within the carrier-free and coating-free edge zone 28 of the laminated pane 20, running primarily along the short edge of the pane 5*b*, for example, under a motor vehicle lining (not shown) in the region of the masking strip 9. The antenna conductor 12 has an adequate distance both from the edge of the pane 5 and from the coating edge 8, by means of which a capacitive coupling to the conductive coating 6 and the motor vehicle body is thwarted. In particular, it is advantageously achieved by means of the segmented edge region 15 that the distance between the conductive coating 6 and the linear antenna effective for high-frequency applications is enlarged.

Since the antenna conductor 12 is situated outside an area 30 indicated schematically in FIG. 2A, which is defined in that every point contained therein can be imaged by orthogonal parallel projection onto the conductive coating 6 serving as a planar antenna and representing a projection area (or onto the part of the conductive coating 6 active as a planar antenna), the linear antenna is not electrically affected by the planar antenna. This area 30 defined by a projection operation is delimited by an imagined bounding surface 32, which is disposed on the coating edge 8 or 8' and is aligned perpendicular to the carrier 21. For the segmented edge region 15, the bounding surface 32 is disposed on the coating edge 8', since the antenna function of the conductive coating 6 is important for the positioning of the antenna conductor.

The first coupling electrode 10 is electrically coupled on a first connector contact 11 (not shown in detail) to the linear antenna conductor 12. In the present exemplary embodiment, the first coupling electrode 10 is galvanically coupled to the antenna conductor 12, with the provision of a capacitive coupling equally possible. The first connector contact 11 of the first coupling electrode 10 or the connection point between the first coupling electrode 10 and the antenna conductor 12 can be considered as an antenna foot point for the pickup of antenna signals of the planar antenna. However, a second connector contact 14 of the antenna conductor 12 actually serves as a common antenna foot point 13 for the pickup of the antenna signals of both the planar antenna and the linear antenna. The antenna signals of the planar antenna and of the linear antenna are thus made available on the second connector contact 14.

The second connector contact 14 is electrically coupled to a connector conductor 19 acting parasitically as an antenna. In the present exemplary embodiment, the connector conductor 19 is galvanically coupled to the second connector contact 14, but with the provision of a capacitive coupling equally possible. The hybrid antenna structure 1 is electrically connected, via the connector conductor 19 and a connector 31 connected thereto, to downstream electronic components, for example, an antenna amplifier, with the antenna signals led out of the laminated pane 20 through the connector conductor 19. As is depicted in FIG. 2B, the connector conductor 19 extends from the adhesive layer 21 past the edge of the pane 5 to the fourth pane surface 27 (side IV), and then leads away from the laminated pane 20. The spatial position of the second connector contact 14 is selected such that the connector conductor 19 is as short as possible and its parasitic effect as an antenna is minimized such that it is possible to do without the use of a conductor specifically designed for high-frequency applications. The connector conductor 19 is preferably shorter than 100 mm. Accordingly, the connector conductor 19 is implemented, in this case, for example, as an unshielded stranded wire or foil conductor that is cost-effective and space-saving and, in addition, can be connected using a relatively simple connection method. The width of the connector conductor 19 implemented in this case, for example, as a flat conductor, tapers, preferably toward the edge of the pane 5, to thwart capacitive coupling with the motor vehicle body.

In the hybrid antenna structure 1, the transparent, electrically conductive coating 6 can, depending on material composition, fulfill other functions. For example, it can serve as a heat-ray reflecting coating for the purpose of solar protection, thermoregulation, or heat insulation or as a heating layer for the electrical heating of the laminated pane 20. These functions are of secondary importance for the present invention.

Furthermore, the outer pane 2 is provided with an opaque color layer that is applied on the second pane surface 25 (side II) and forms a frame-like circumferential masking strip 9, which is not depicted in detail in the figures. The color layer is made, preferably, of an electrically non-conductive, black pigmented material that can be baked into the outer pane 2. On the one hand, the masking strip 9 prevents the visibility of an adhesive strand with which the laminated pane 20 can be glued into a motor vehicle body; on the other, it serves as UV protection for the adhesive material used.

The conductive coating 6 serving as a planar antenna is provided with two flat regions protruding out to the adjacent on edge of the pane 5*a*, which, in each case, serves as a second (capacitive) coupling electrode 36, 36'. In FIG. 1, the two flat protrusions have at least approximately a rectangular shape, with provision of any other shape suitable for the application equally possible. The conductive coating 6 has, in the flat sections adjacent the two second coupling electrodes 36, 36', no segmented edge region 15. The two second coupling electrodes 36, 36' extend, in each case, into the otherwise coating-free edge strip 7.

Figure 2C:
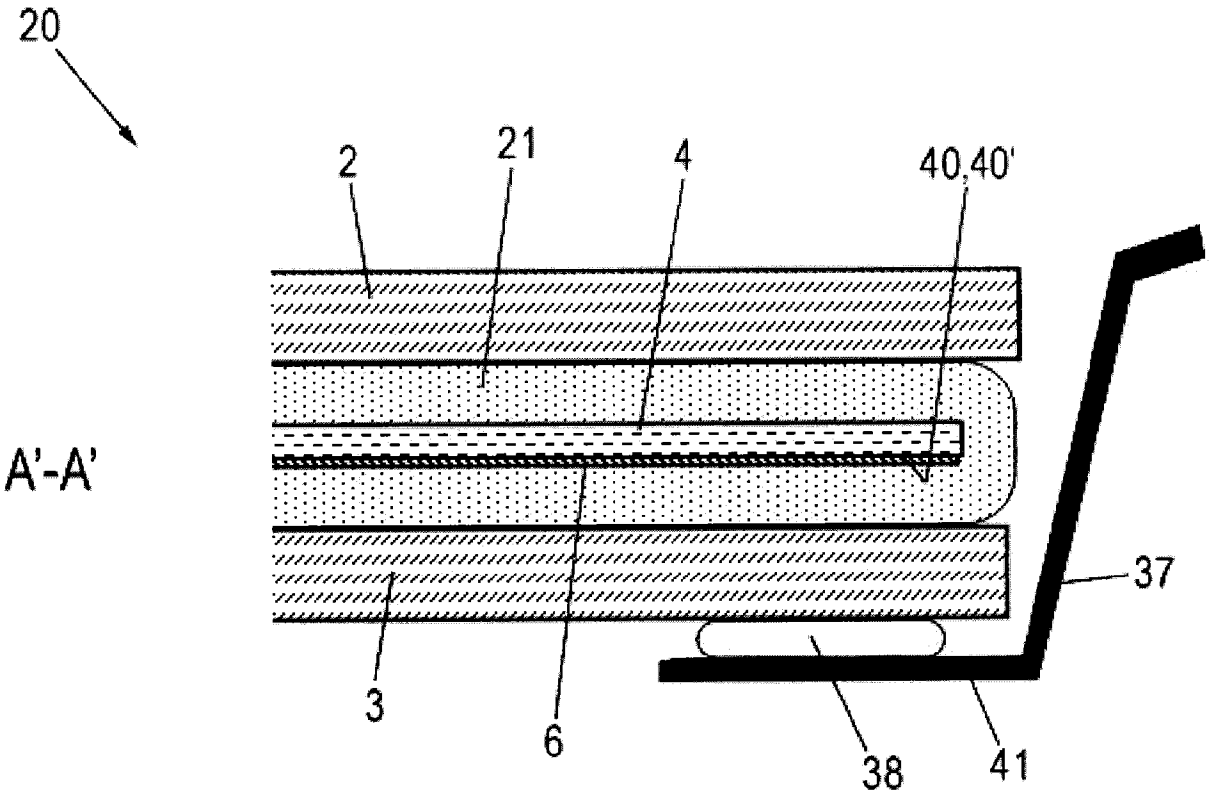
Figure 2D:
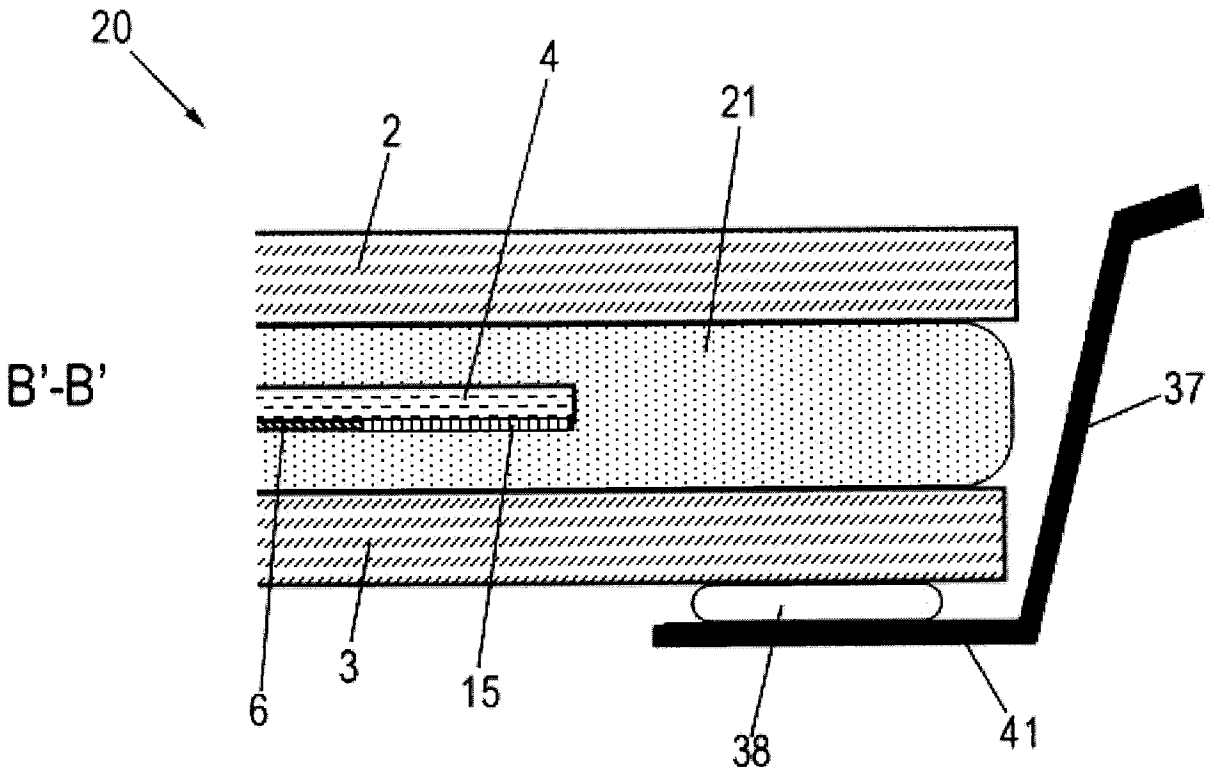

As depicted in FIG. 2C, the carrier 4 with the conductive coating 6 comes into a position opposite an electrically conductive structure 37 and is capacitively coupled thereto. More precisely: A first flat section 40, 40' of the coating 6, which corresponds to the second coupling electrode 36, 36' and serves as a first capacitive coupling surface is situated in a parallel opposing position to a second surface section 41 of the electrically conductive structure 37, which serves as a second capacitive coupling surface (coupling counter surface), with the two first coupling surfaces capacitively coupled to the second coupling surface. The electrically conductive structure 37 can be, for example, the body of a motor vehicle. The electrically conductive structure 37 is, in this case, for example, fixedly bonded to the fourth pane surface 27 of the inner pane 3 by means of an adhesive bead bead 38. Thereafter, the conductive coating 6 is capacitively coupled by the two second coupling electrodes 36, 36' to the electrically conductive structure 37. As depicted in FIG. 2D, the conductive coating 6 outside the two second coupling electrodes 36, 36' is not situated in a position opposing the conductive structure 37 such that it is not capacitively coupled to the conductive structure 37.

Now, for example, in a motor vehicle, diverse sources of interference, such as clocked electrical devices, for example, sensors, cameras, engine control devices, and the like, can emit electromagnetic interfering signals in the form of free space electromagnetic waves, that can be received by the conductive coating 6 serving as a planar antenna because of the large antenna area. In FIG. 1, by way of example, two physical sources of interference 39, 39' are schematically depicted by means of the projection site in the region of the coating-free edge strip 7 at the top and bottom long edge of the pane 5*a*.

The interfering signals of the two sources of interference 39, 39' received by the planar antenna have, in the two source of interference area zones 42, 42', a extremely high signal amplitude or a signal amplitude that is above a definable amplitude value. The points of the upper source of interference area zone 42 have an extremely short (for example, vertical) distance from the upper source of interference 39, and the points of the lower source of interference area zone 42' have an extremely short (for example, vertical) distance from the lower source of interference 39'. The shapes of the source of interference area zones 42, 42' depend on the respective shapes of the sources of interference 39, 39', with the understanding that the shapes depicted in FIG. 1 are to be considered only as examples.

As depicted in FIG. 1, the second coupling electrode 36 is disposed near the first coupling electrode 10 and is situated between the first coupling electrode 10 and the upper source of interference area zone 42 of the upper source of interference 39. The second coupling electrode 36 has, in this case, for example, a geometric distance from the first coupling electrode 10, that is less 7.5 cm, corresponding to one fourth of the minimum wavelength of interfering signals in the frequency range of the terrestrial broadcast bands III-V. The second coupling electrode 36' is disposed near the lower source of interference area zone 42' of the lower source of interference 39'. The second coupling electrode 36' has, in this case, for example, a geometric distance from the lower source of interference area zone 42', that is less than 7.5 cm. In addition, the two second coupling electrodes 36, 36' have, together with the coupling counter surface of the conductive structure 37, a frequency-selective passthrough behavior and act as a high pass filter, wherein the two second coupling electrodes 36, 36' and the coupling counter surface of the conductive structure 37 are, in this case, for example, configured such that they only allow passage of frequencies above 170 MHz. The two second coupling electrodes 36, 36' thus act frequency-selectively for the terrestrial broadcast bands III-V. In the present case, it is assumed that the interfering signals of the two sources of interference 39, 39' are situated in a frequency range above 170 MHz. The desired frequency selectivity can be obtained in a simple manner by setting the capacitive properties of the second coupling electrodes 36, 36' capacitively coupled to the conductive structure 37. For this purpose, it is merely necessary to set the size of the (capacitively active) surfaces of the second coupling electrodes 36, 36' and the conductive structure 37 situated in the opposing position and size of the distance between these capacitively active surfaces in a suitable manner.

The interfering signals received from the upper source of interference 39 (and, additionally, from the lower source of interference 39') are thus extracted with priority from the conductive coating 6 serving as a planar antenna based on the frequency-selective passthrough behavior of the upper second coupling electrode 36. In addition, the interfering signals of the upper source of interference 39 are extracted with priority from the second coupling electrode 36, based on the physical position between the upper source of interference area zone 42 and the first coupling electrode 10 from a surface section of the conductive coating 6 containing the upper source of interference area zone 42 and the upper second coupling electrode 36. On the other hand, the interfering signals received from the lower source of interference 39' are extracted with priority from the conductive coating 6 based on the physical proximity of the second coupling electrode 36' to the lower source of interference area zone 42' and, in addition, based on the frequency-selective passthrough behavior of the second coupling electrode 36' with priority from the lower second coupling electrode 36'. The physical proximity of the second coupling electrode 36' to the lower source of interference area zone 42' causes, at the time of signal reception, differences in potential between a surface section containing the lower source of interference area zone 42' and the lower second coupling electrode 36', that are greater than the differences in potential between this surface section and the first coupling electrode 10 such that these interfering signals are extracted with priority via the lower second coupling electrode 36'.

However, the first coupling electrode 10 can extract antenna signals from flat sections of the conductive coating 6 different from the source of interference area zones 42, 42', in which, at the time of signal reception, differences in potential relative to the first coupling electrode 10 appear, which are greater than differences in potential relative to the two second coupling electrodes 36, 36'. Useful signals that are in the frequency range extracted as interfering signals via the electrically conductive structure 37 (ground), can advantageously be received via the antenna conductor 12 serving as a linear antenna such that virtually no signal loss occurs. The antenna conductor 12 is not or is only negligibly interfered with by the interfering signals of the sources of interference 39, 39'. The antenna assembly 100 with a hybrid antenna structure 1 is thus distinguished by an outstanding signal-to-noise ratio.

Various embodiments of the antenna assembly 100 with a hybrid antenna structure 1 are explained in the following with reference to the other figures, wherein, in each case, a capacitive coupling of the second coupling electrodes 36, 36' to the conductive structure 37 is realized.

Figure 3A:
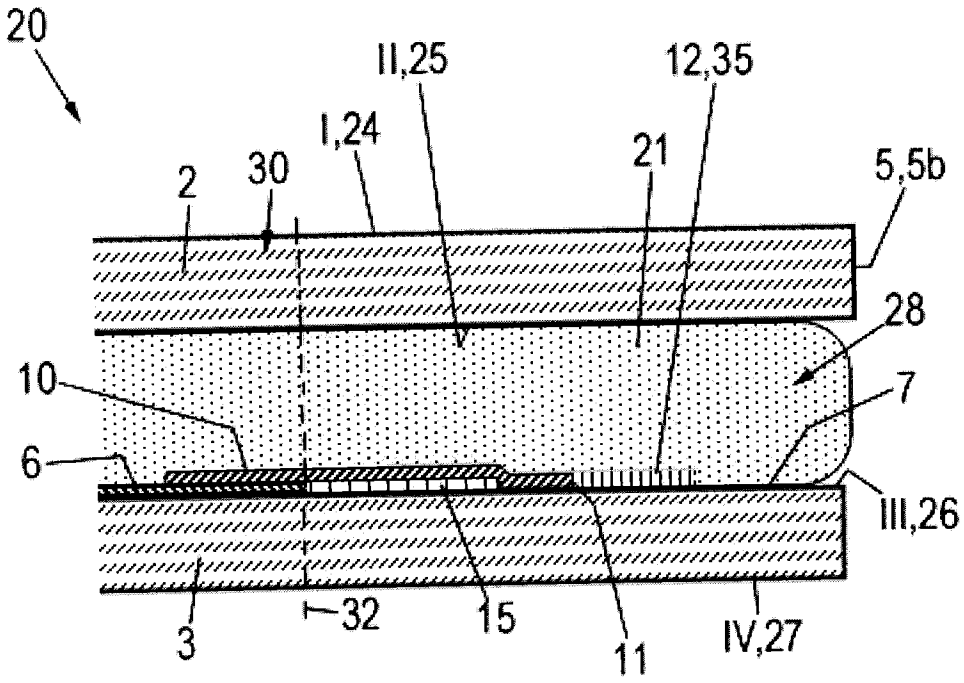
FIG. 3A-3B cross-sectional views of a first variant of the hybrid antenna assembly of FIG. 1 along section line A-A (FIG. 3A) and section line B-B (FIG. 3B)
Figure 3B:
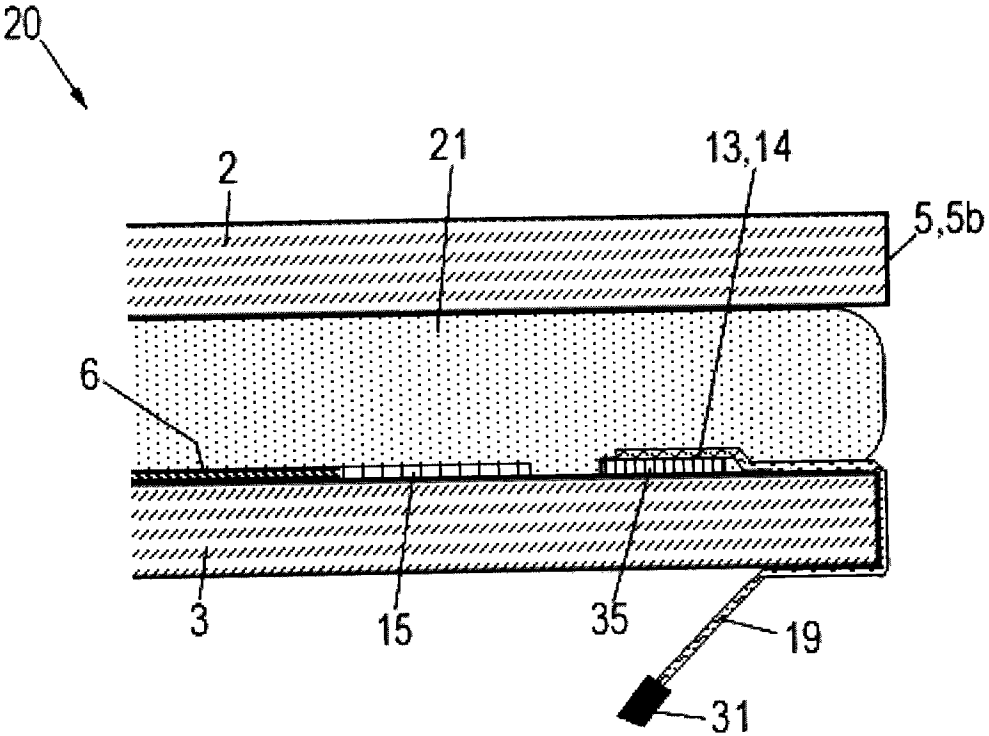

Reference is now made to FIGS. 3A and 3B, in which a first variant of the antenna assembly 100 with a hybrid antenna structure 1 is depicted. In order to avoid unnecessary repetition, only the differences relative to the exemplary embodiment of FIGS. 1, 2A, and 2B are described; and, for the rest, reference is made to the statements made there. According to this variant, no carrier 4 for the conductive coating 6 is provided in the laminated pane 20, as the conductive coating 6 is applied on the third pane surface 26 (side III) of the inner pane 3. The conductive coating 6 does not reach all the way to the edge of the pane 5, such that a circumferential, coating-free edge strip 7 remains on all sides of the third pane surface 26. The width of the circumferential edge strip 7 can vary widely. Preferably, the width of the edge strip 7 is in the range from 0.2 to 1.5 cm, more preferably in the range from 0.3 to 1.3 cm, and particularly preferably in the range from 0.4 to 1.0 cm. The edge strip 7 serves in particular for electrical insulation of the conductive coating 6 toward the outside and for reduction of a capacitive coupling to surrounding conductive structures. The edge strip 7 can be produced by later removal of the conductive coating 6, for example, by abrasive ablation, laser ablation, or etching, or by masking the inner pane 3 before the application of the conductive coating 6 on the third pane surface 26.

The antenna conductor 12 serving as a linear antenna is applied on the third pane surface 26 in the region of the coating-free edge strip 7. In the variant depicted, the antenna conductor 12 is implemented in the form of a flat conductor path 35, which is preferably applied by printing, for example, by screenprinting, of a metallic printing paste. Thus, the linear antenna and the planar antenna are situated on the same surface (side III) of the inner pane 3. The strip-shaped first coupling electrode 10 extends to above the linear antenna conductor 12 and is galvanically coupled thereto, with the provision of a capacitive coupling equally possible. The antenna conductor 12 is situated outside the area 30 indicated schematically in FIG. 3A, in which every point can be imaged by orthogonal parallel projection onto the planar antenna, such that the linear antenna is not electrically loaded by the planar antenna. FIG. 3A depicts schematically the (imagined) bounding surface 32 delimiting the area 30, which is aligned perpendicular to the third pane surface 26 and is disposed on the coating edge 8 or 8' (in the edge region 15). In other words, the linear antenna conductor 12 is situated in an area not characterized in detail, in which every point can be imaged by orthogonal parallel projection onto the coating-free edge strip 7 serving as a projection area. Electrical loading of the linear antenna by the planar antenna is advantageously avoided in this manner.

Figure 4A:
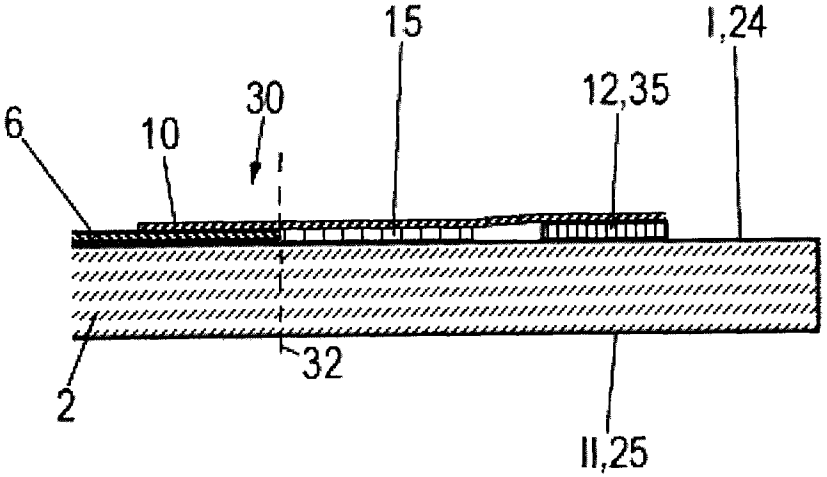
FIG. 4A-4B cross-sectional views of a second variant of the hybrid antenna assembly of FIG. 1 along section line A-A (FIG. 4A) and section line B-B (FIG. 4B)
Figure 4B:
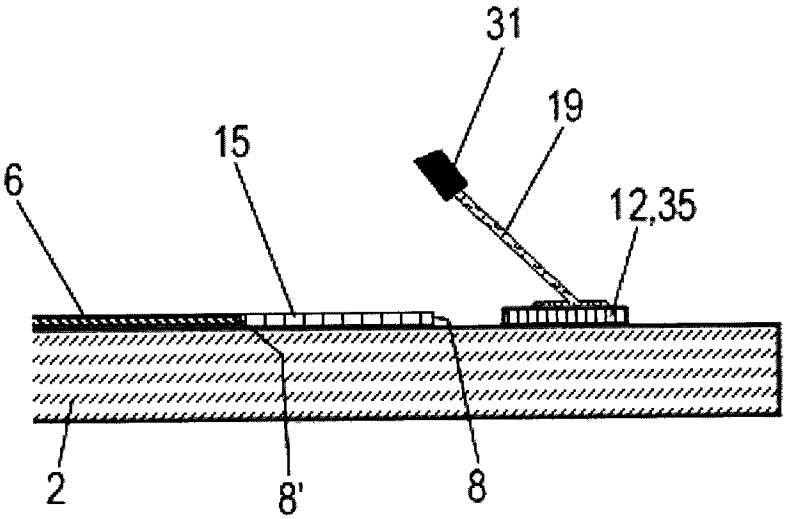

FIGS. 4A and 4B depict a second variant of the antenna assembly 100 with a hybrid antenna structure 1, with only the differences relative to the first variant of FIGS. 3A and 3B described; and, for the rest, reference is made to the statements made there. According to this variant, no laminated pane 20 is provided, but rather only a single pane glass with one individual pane corresponding, for example, to outer pane 2. The conductive coating 6 is applied on the first pane surface 24 (side I), with the conductive coating 6 not reaching all the way to the edge of the pane 5 such that a circumferential, coating-free edge strip 7 remains on all sides of the first pane surface 24. In the region of the coating-free edge strip 7, the linear antenna conductor 12 implemented in the form of a conductor path 35 and serving as a linear antenna is applied on the first pane surface 24. The antenna conductor 12 is thus situated outside the area 30 schematically indicated in FIG. 4A, in which every point can be imaged by orthogonal parallel projection onto the planar antenna. The connector conductor 19 makes contact with the second connector contact 14 of the antenna conductor 12 and then leads on the same side of the outer pane 2 away from the antenna conductor 12.

Figure 5A:
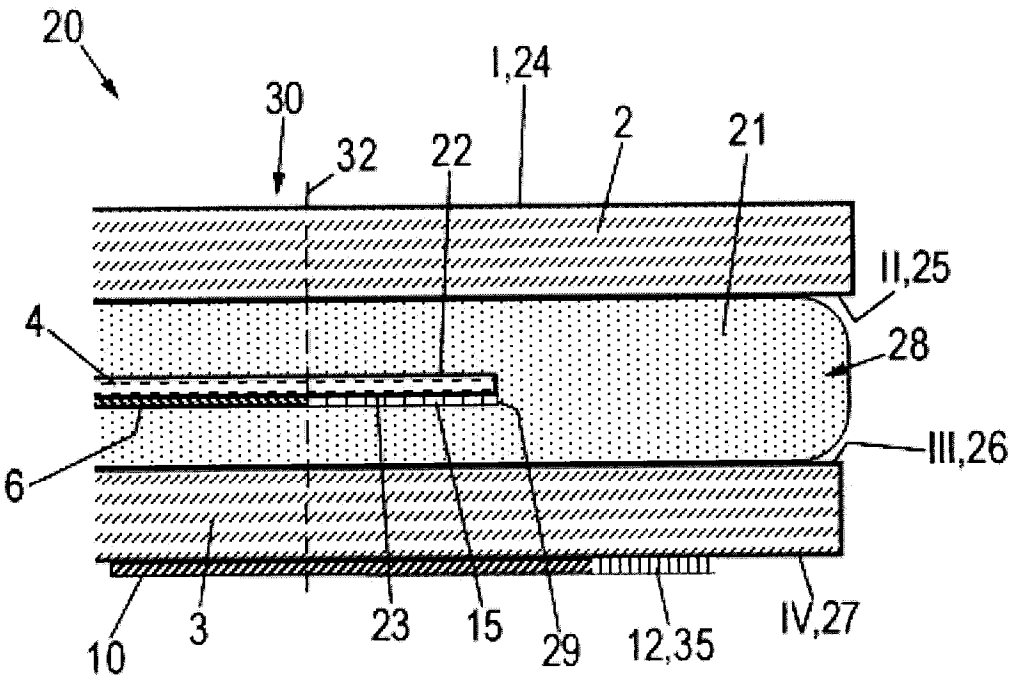
FIG. 5A-5B cross-sectional views of a third variant of the hybrid antenna assembly of FIG. 1 along section line A-A (FIG. 5A) and section line B-B (FIG. 5B)
Figure 5B:
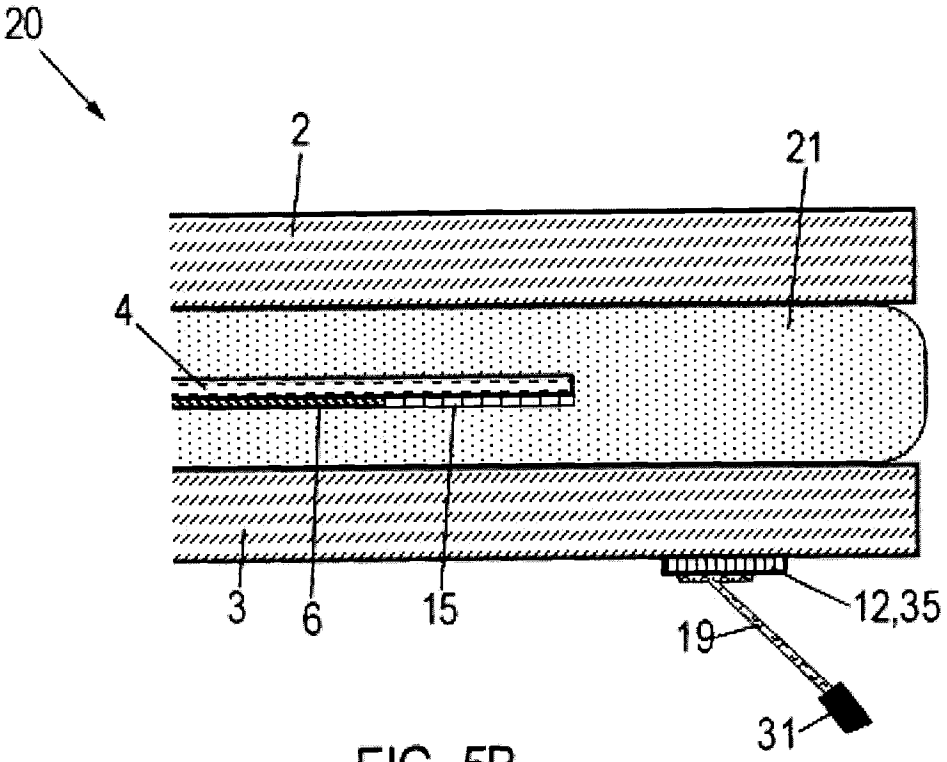

FIGS. 5A and 5B depict a third variant of the antenna assembly 100 with a hybrid antenna structure 1, with only the differences relative to the first exemplary embodiment of FIGS. 1, 2A, and 2B described; and, for the rest, reference is made to the statements made there. According to this variant, a carrier 4 is provided in the laminated pane 20, on which carrier the conductive coating 6 is applied. The strip-shaped first coupling electrode 10 is applied on the fourth surface (side IV) of the inner pane 3 and capacitively coupled to the conductive coating 6 serving as a planar antenna. The antenna conductor 12 serving as a linear antenna is likewise applied on the fourth pane surface 27 of the inner pane 3, for example, by printing, for example, screenprinting, and galvanically coupled to the coupling electrode, but with the provision of a capacitive coupling equally possible. Thus, the planar antenna and the linear antenna are situated on different surfaces of substrates different from each other. The antenna conductor 12 is situated outside the area 30, in which every point can be imaged by orthogonal parallel projection onto the planar antenna 6 such that the linear antenna is not electrically loaded by the planar antenna. The connector conductor 19 makes contact with the antenna conductor 12 and leads directly away from the laminated pane 20.

Figure 6:
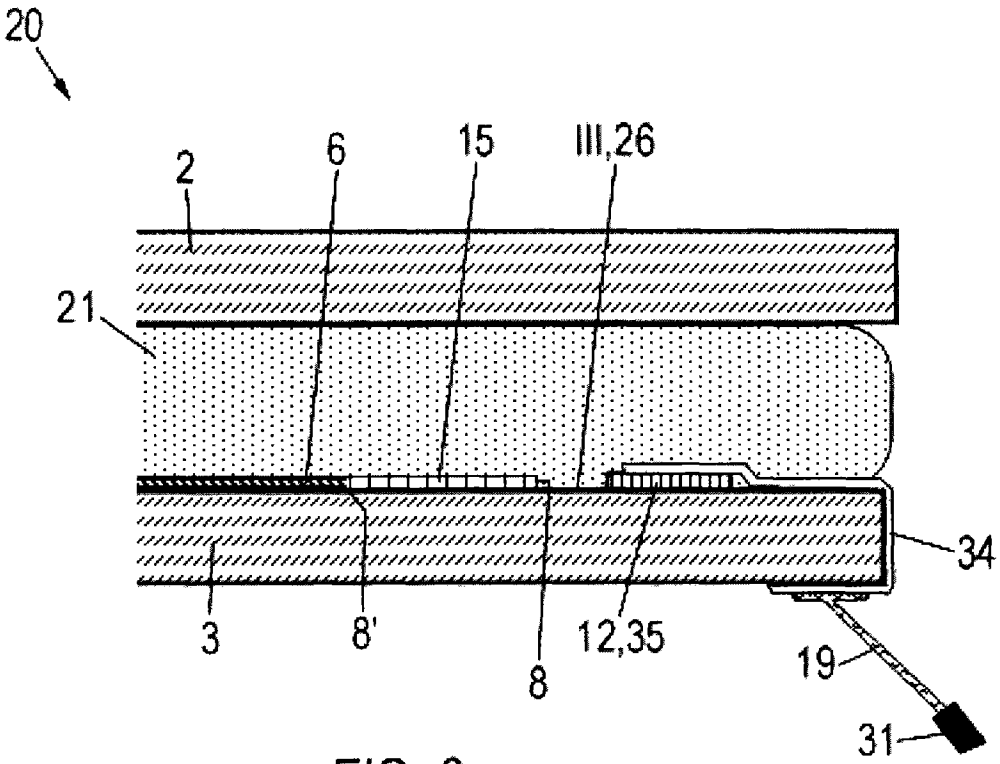
FIG. 6 a cross-sectional view of a fourth variant of the hybrid antenna assembly of FIG. 1 along section line B-B.

FIG. 6 depicts a fourth variant of the antenna assembly 100 with a hybrid antenna structure 1, with only the differences relative to the third variant of FIGS. 5A and 5B described; and, for the rest, reference is made to the statements made there. According to this variant, the linear antenna conductor 12 configured as a flat conductor path 35 is applied on the third pane surface 26 of the inner pane 3. A second connection conductor 34 is applied on the antenna conductor 12 in the antenna foot point and extends beyond the short edge of the pane 5*b* to the fourth pane surface 27 (side IV) of the inner pane 3. In the variant depicted, the second connection conductor 34 is galvanically coupled to the antenna conductor 12, with the provision of a capacitive coupling equally possible. The second connection conductor 34 can be manufactured, for example, from the same material as the coupling electrode 10. The connector conductor 19 makes contact with the second connection conductor 34 on the fourth pane surface 27 and leads away from the laminated pane 20. The width (dimension perpendicular to the extension direction) of the second connection conductor 34 configured as a strip-shaped flat conductor preferably tapers toward the short edge of the pane 5*b* such that a capacitive coupling between the conductive coating 6 and the electrically conductive motor vehicle body can be prevented.

Figure 7:
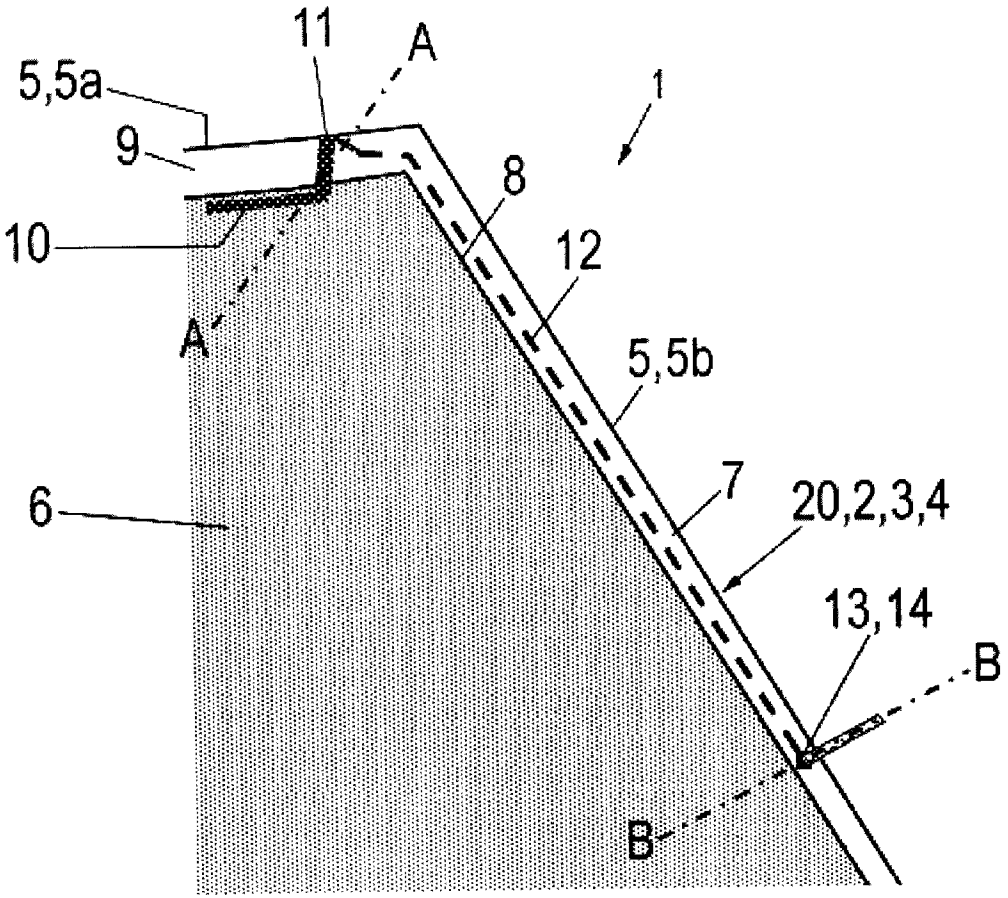
FIG. 7 a schematic perspective view of a hybrid antenna assembly according to a second exemplary embodiment of the invention embodied in the form of a laminated pane.
Figure 8A:
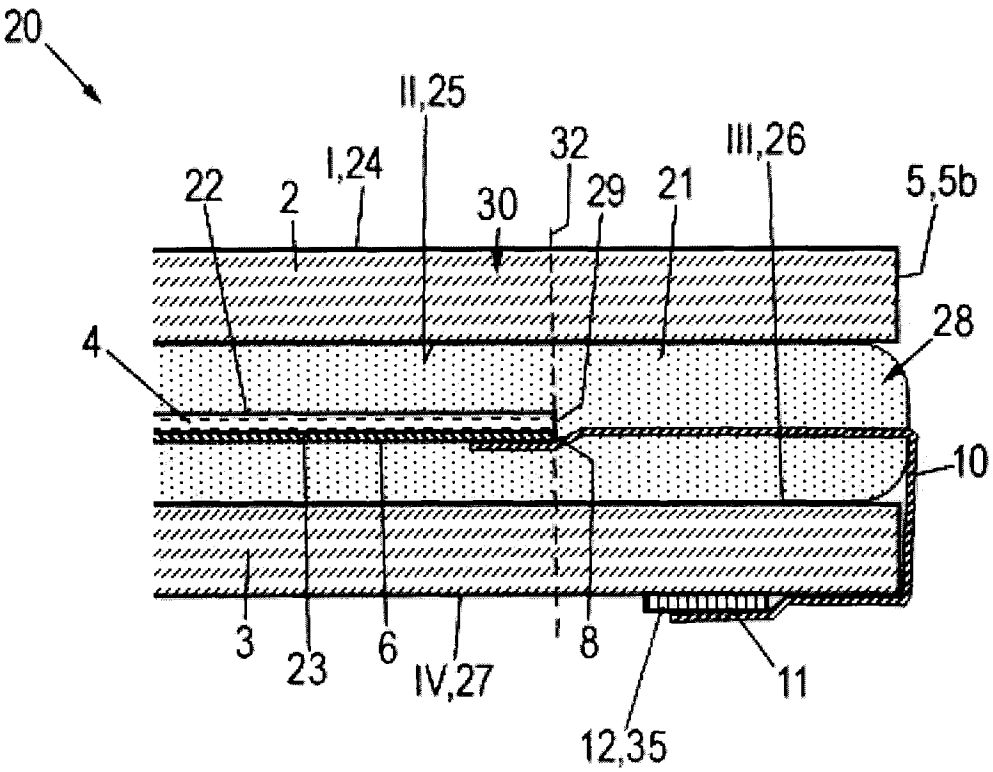
FIG. 8A-8B cross-sectional views of the hybrid antenna assembly of FIG. 7 along section line A-A (FIG. 8A) and section line B-B (FIG. 8B)
Figure 8B:
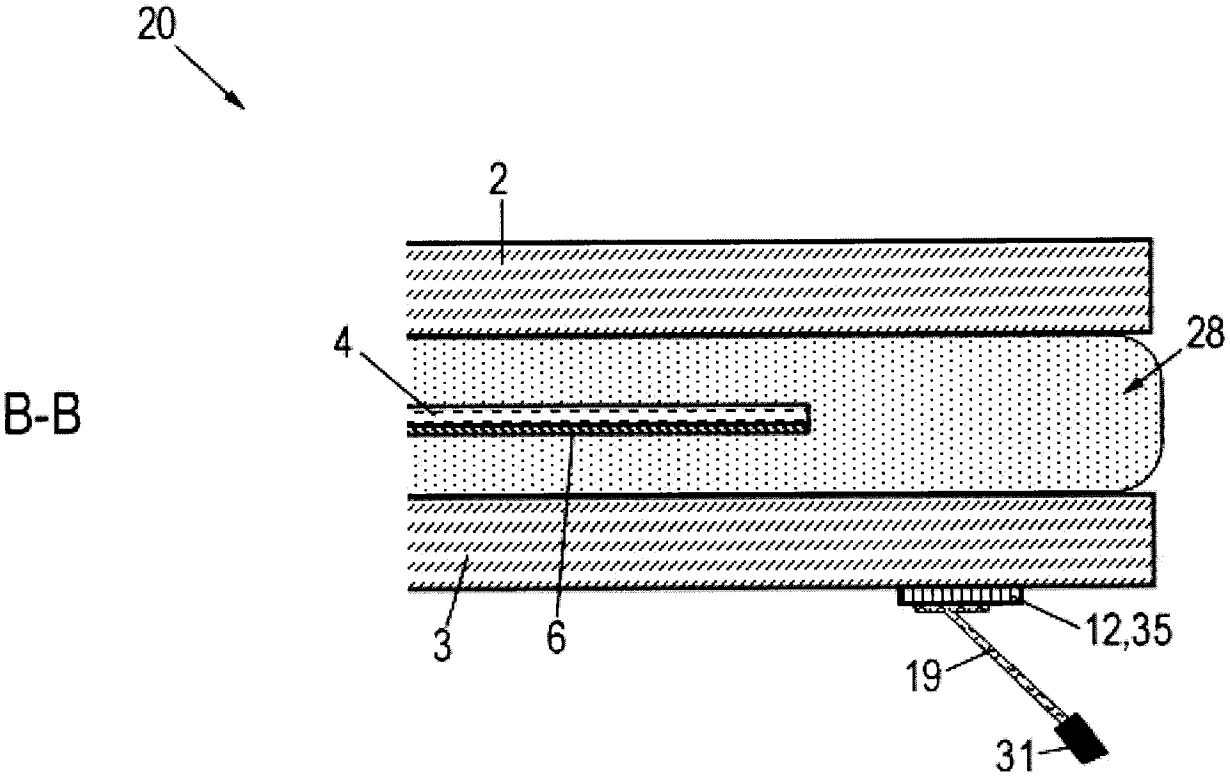

FIGS. 7, 8A, and 8B depict a second exemplary embodiment of the antenna assembly with a hybrid antenna structure 1 according to the invention, with only the differences relative to the first exemplary embodiment of FIGS. 1, 2A, and 2B described; and, for the rest, reference is made to the statements made there. According to this embodiment, a laminated pane 20 is provided with a carrier 4 embedded in the adhesive layer 21 and a transparent, conductive coating 6 applied on the second carrier surface 23. The conductive coating 6 is applied on the entire surface of the second carrier surface 23, without implementing a segmented edge region 15; but with its provision equally possible.

The first coupling electrode 10 abuts the conductive coating 6 and is galvanically coupled thereto, but with provision of a capacitive coupling equally possible. The first coupling electrode 10 extends past the upper, long edge of the pane 5*a* to the fourth pane surface 27 (side IV) of the inner pane 3. The linear antenna conductor 12 is applied, analogously to the third variant of the first exemplary embodiment described in conjunction with FIGS. 5A and 5B, as a conductor path 35 on the fourth pane surface 27 of the inner pane 3. At its other end, the first coupling electrode 10 abuts the antenna conductor 12 and is galvanically coupled thereto, but with provision of a capacitive coupling equally possible. The antenna conductor 12 is situated outside the area 30, in which every point can be imaged by orthogonal parallel projection onto the planar antenna such that the linear antenna is not electrically loaded by the planar antenna. The connector conductor 19 makes contact with the antenna conductor 12 and leads directly away from the laminated pane 20.

Figure 9:
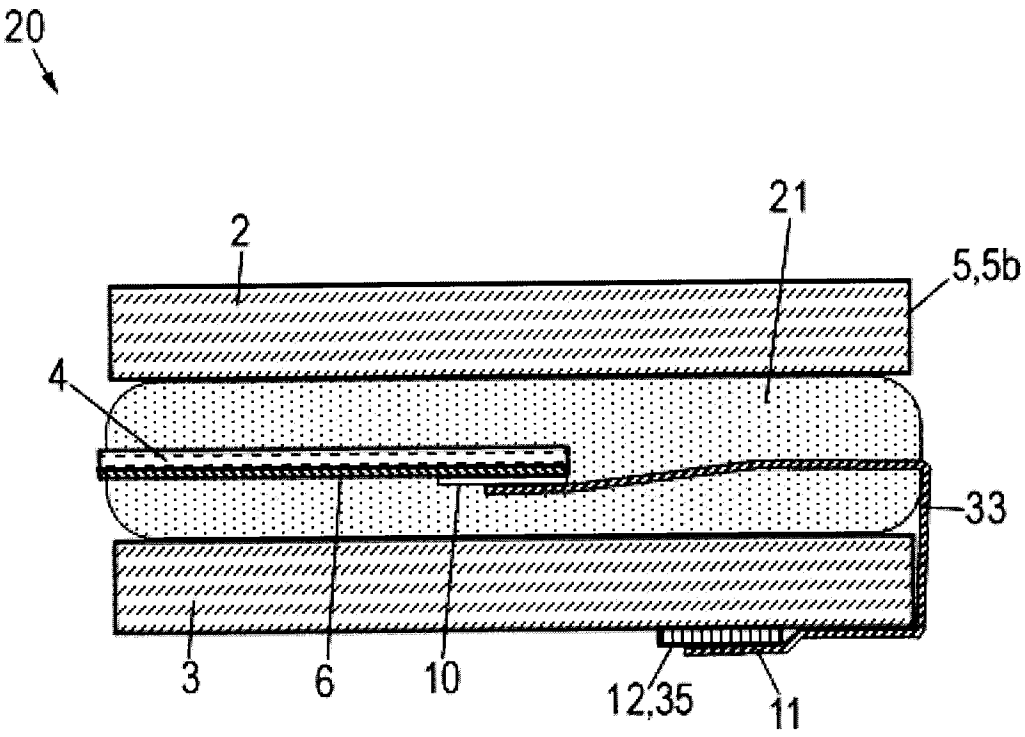
FIG. 9 a cross-sectional view of a variant of the hybrid antenna assembly of FIG. 7 along section line A-A.

FIG. 9 depicts a variant with, to avoid repetitions, only the differences relative to the second exemplary embodiment of FIGS. 7, 8A, and 8B explained. According to this variant, the first coupling electrode 10 is implemented only in the region of the conductive coating 6, abuts it in direct contact, and is thus galvanically coupled to the conductive coating 6, with the provision of a capacitive coupling equally possible. A first connection conductor 33 abuts, at one of its ends, the first coupling electrode 10 in direct contact and is galvanically coupled to the conductive coating 6, but with the provision of a capacitive coupling equally possible. The first connection conductor 33 extends past the upper long edge of the pane 5*a* to the fourth pane surface 27 (side IV) of the inner pane 3 and makes contact, at its other end, with the antenna conductor 12 implemented as a conductor path. The first connection conductor 33 abuts the antenna conductor 12 in direct contact and is galvanically coupled thereto, for example, by a solder contact, but with the provision of a capacitive coupling equally possible. The first connection conductor 33 can be manufactured, for example, from the same material as the first coupling electrode 10 such that the first coupling electrode 10 and the first connection conductor 33 can be considered together as a two-part coupling electrode. The width (dimension perpendicular to the extension direction) of the first connection conductor 33 configured as a strip-shaped flat conductor preferably tapers toward the long edge of the pane 5*a* such that a capacitive coupling between the conductive coating 6 and the motor vehicle body can be prevented.

The invention makes available an antenna assembly with a hybrid antenna structure that enables bandwidth optimized reception of electromagnetic waves, wherein, through the planar and linear antenna combination, satisfactory reception performance can be achieved over the complete frequency range of bands I-V. By means of the possibility that interfering signals of external sources of interference received by the planar antenna as free space waves can be extracted via a ground capacitively coupled to the planar antenna, the antenna assembly has an excellent signal-to-noise ratio.

LIST OF REFERENCE CHARACTERS

1 antenna structure
2 outer pane
3 inner pane
4 carrier
5 edge of the pane
5*a* long edge of the pane
5*b* short edge of the pane
6 coating
7 edge strip
8, 8' coating edge
9 masking strip
10 first coupling electrode
11 first connector contact
12 antenna conductor
13 antenna foot point
14 second connector contact
15 edge region
16 segment
17 insulating region
18 wire
19 connector conductor
20 laminated pane
21 adhesive layer
22 first carrier surface
23 second carrier surface
24 first pane surface
25 second pane surface
26 third pane surface
27 fourth pane surface
28 edge zone
29 carrier edge
30 area
31 Connector
32 bounding surface
33 first connection conductor
34 second connection conductor
35 conductor path
36, 36' second coupling electrode
37 conductive structure
38 adhesive bead
39, 39' source of interference
40, 40' first flat section
41 second flat section
42, 42' source of interference area zone
100 antenna assembly

The invention claimed is:

1. An antenna assembly, comprising:

at least one electrically insulating substrate;

an electrically conductive structure defining a ground;

at least one electrically conductive transparent coating, which covers more than 70% of a surface of the substrate and serves as a planar antenna to receive electromagnetic signals comprising first signals in a frequency range of first and second terrestrial broadcast bands and second signals in a frequency range of third to fifth terrestrial broadcast bands;

at least one first coupling electrode galvanically or capacitively connected to the conductive coating to couple out the first signals from the planar antenna, the first coupling electrode being electrically coupled to an unshielded, linear antenna conductor, which serves as a linear antenna to receive electromagnetic waves, the linear antenna conductor being situated outside an area that is projected by orthogonal parallel projection onto the planar antenna serving as the projection area, by which one antenna foot point of the linear antenna becomes a common antenna foot point of the linear and planar antenna;

at least one second coupling electrode galvanically connected to the conductive coating to couple out the second signals from the planar antenna, wherein the at least one second coupling electrode is implemented in the form of a protruding edge section of the conductive coating, wherein the at least one second coupling electrode includes a first coupling surface and the conductive structure includes a second coupling surface capacitively coupled to the first coupling surface, and wherein sizes of the first and second coupling surfaces and a distance between the first and second coupling surfaces are configured such that they selectively allow passage of the second signals.

2. An antenna assembly according to claim 1, wherein the at least one second coupling electrode is disposed near the first coupling electrode.

3. An antenna assembly according to claim 1, wherein the at least one second coupling electrode is disposed between a source of interference area zone of the conductive coating, whose points are at a distance as short as possible from the at least one source of interference, and the first coupling electrode.

4. An antenna assembly according to claim 3, wherein the at least one second coupling electrode is at a distance from the source of interference area zone that is less than one fourth of a minimum wavelength of the interfering signal.

5. An antenna assembly according to claim 1, wherein a geometric distance between the at least one second coupling electrode and a source of interference area zone of the conductive coating, whose points are at a distance as short as possible from the at least one source of interference, is less than a geometric distance between the first coupling electrode and the source of interference area zone.

6. An antenna assembly according to claim 1, wherein the capacitively coupled coupling surfaces of the at least one second coupling electrode and the conductive structure are configured such that they selectively allow passage of a frequency range above 170 MHz.

7. An antenna structure, comprising:

at least one electrically insulating substrate;

at least one electrically conductive transparent coating, which covers more than 70% of a surface of the substrate and serves as a planar antenna to receive electromagnetic signals comprising first signals in a frequency range of first and second terrestrial broadcast bands and second signals in a frequency range of third to fifth terrestrial broadcast bands;

at least one first coupling electrode electrically coupled to the conductive coating to couple out the first signals, wherein the first coupling electrode is electrically coupled to an unshielded, linear antenna conductor, which serves as a linear antenna to receive electromagnetic waves, wherein the linear antenna conductor is situated outside an area that is projected by orthogonal parallel projection on the planar antenna serving as the projection area, by which one antenna foot point of the linear antenna becomes a common antenna foot point of the linear and planar antenna;

at least one second coupling electrode galvanically connected to the conductive coating to couple out the second signals, wherein the at least one second coupling electrode is implemented in the form of a protruding edge section of the conductive coating, wherein the at least one second coupling electrode includes a first coupling surface that is configured to be capacitively coupled to a second coupling surface of an electrically conductive structure defining an electrical ground, and wherein the sizes of the coupling surfaces and a distance between the coupling surface is configured such that they selectively allows passage of the second signals.

8. A use of an antenna structure according to claim 7 as a functional individual piece and as a built-in part in furniture, devices, and buildings, as well as in means of transportation for travel on land, in air, or on water, or in motor vehicles, or as a windshield, a rear window, a side window, and/or a glass roof.

9. A method for operation of an antenna assembly, comprising:

receiving of signals by a planar antenna, which is implemented in a form of an electrically conductive transparent coating applied on at least one electrically insulating substrate, which covers more than 70% of a surface of the substrate, the signals comprising first signals in a frequency range of first and second terrestrial broadcast bands and second signals in a frequency range of third to fifth terrestrial broadcast bands;

coupling out of the first signals from the planar antenna by a first coupling electrode galvanically or capacitively connected to the coating, wherein the first coupling electrode is electrically coupled to an unshielded, linear antenna conductor, which serves as a linear antenna to couple electromagnetic waves, wherein the linear antenna conductor is situated outside an area that is protected by orthogonal parallel projection onto the planar antenna serving as the projection area, by which one antenna foot point of the linear antenna becomes a common antenna foot point of the linear and planar antenna;

selectively coupling out of the second signals from the planar antenna by a second coupling electrode galvanically connected to the coating, which second coupling electrode is implemented in the form of a protruding edge section of the conductive coating and is capacitively coupled to a conductive structure defining a ground wherein the second coupling electrode includes a first coupling surface and the conductive structure includes a second coupling surface capacitively coupled to the first coupling surface, and wherein the sizes of the coupling surfaces and a distance between the coupling surfaces are configured such that they selectively allow passage of the second signals.

* * * * *